United States Patent [19]

Colin

[11] Patent Number: 4,871,346

[45] Date of Patent: Oct. 3, 1989

[54] APPARATUS FOR MANUFACTURING BAGS MADE OF PLASTIC MATERIAL

[76] Inventor: Louis Colin, via Ca'dell'Orbo, 29-a0055 Villanova Di Castenaso (Province of Bologna), Italy

[21] Appl. No.: 221,203

[22] Filed: Jul. 19, 1988

[30] Foreign Application Priority Data

Jul. 28, 1987 [IT] Italy ..... 3575 A/87

[51] Int. Cl.[4] ..... B65H 35/06

[52] U.S. Cl. ..... 493/194; 493/204

[58] Field of Search ..... 493/194, 195, 196, 204, 493/206, 209

[56] References Cited

U.S. PATENT DOCUMENTS

| | | | |
|---|---|---|---|
| 4,128,049 | 12/1978 | Lehmacher | 493/206 |
| 4,490,207 | 12/1984 | Achelpohl | 493/204 |
| 4,734,088 | 3/1988 | Achelpohl et al. | 493/209 |
| 4,758,214 | 7/1988 | de Bin | 493/204 |

*Primary Examiner*—Frederick R. Schmidt

*Assistant Examiner*—Jack Lavinder

*Attorney, Agent, or Firm*—Dressler, Goldsmith, Shore, Sutker & Milnamow, Ltd.

[57] ABSTRACT

The apparatus for manufacturing bags in plastic material comprises a welding assembly having a pair of fixed jaws and a jaw which is movable therebetween for clamping respective alternately advancing tubular bands made of plastic material. A cutting element, carried by a flexible belt rotatable on the movable jaw, is adapted to cut the bands upon clamping the movable jaw on the fixed jaws. An assembly for extracting and accumulating the bags is provided with a plurality of needles at each fixed jaw and actuated with reciprocating motion in the direction of sliding of the movable jaw so as to penetrate a bag clamped between the jaws. The apparatus also comprises a fork for placing the bag adjacent to the previously produced bags supported on the needles, and a slider for unloading a pack of manufactured bags.

6 Claims, 3 Drawing Sheets

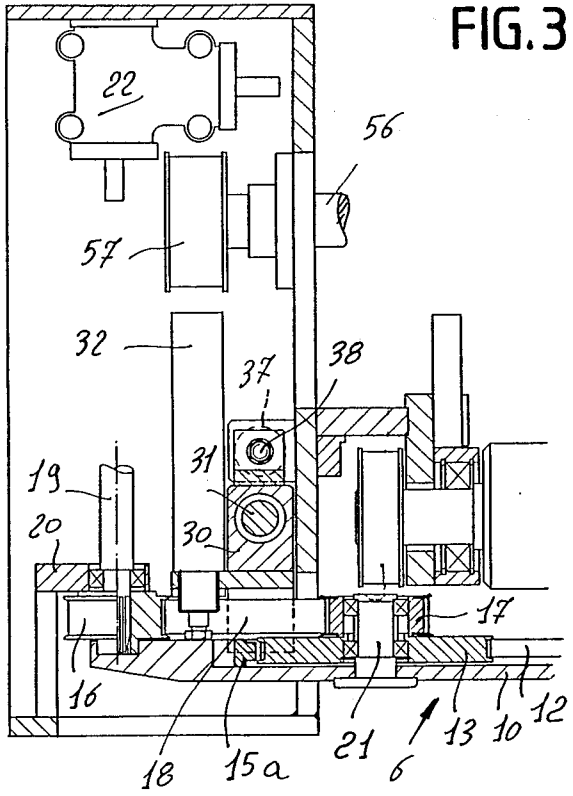
FIG. 3
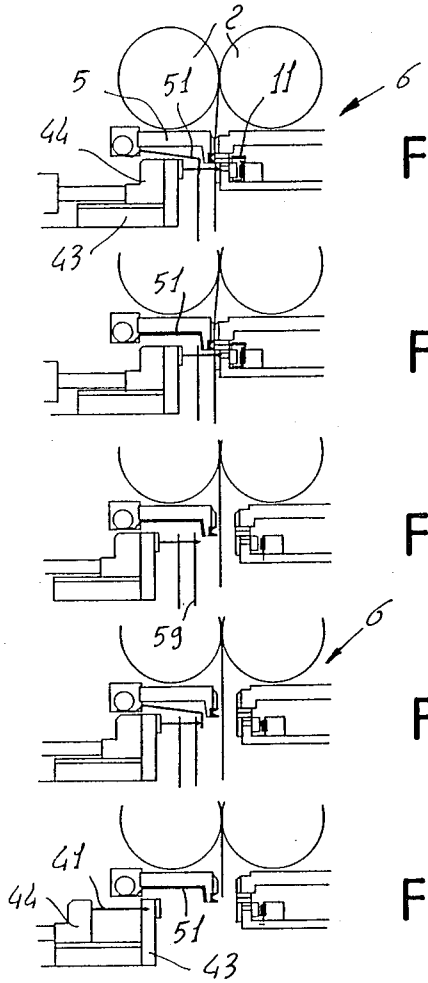
FIG. 4a
FIG. 4b
FIG. 4c
FIG. 4d
FIG. 4e

APPARATUS FOR MANUFACTURING BAGS MADE OF PLASTIC MATERIAL

BACKGROUND OF THE INVENTION

The present invention relates to an apparatus for manufacturing bags made of plastic material, and in particular to an apparatus of the type comprising advancement means and welding, cutting, accumulation and extraction devices for manufacturing bags in thermoplastic material such as polyethylene.

As known, the manufacture of bags in plastic material employs machines which cause the advancement of a web of material defining a tubular sheath, and which weld it and cut it transversely at preset distances so as to form bags which are then gathered on needles or other systems and periodically unloaded and stacked. The web is caused to advance intermittently, by means of one or more pairs of rollers, between a pair of welding jaws, at least one of which is movable. The cutting operation is performed when the web is clamped by the welding jaws, generally by means of a blade carried by a belt along a path which intercepts said web or by means of guillotine blades or cutting combs.

In the case of a moving blade, the cutting operation is generally performed at high speed in order to require a very short time and thus avoid operating when the web is very hot, since by softening it would risk tearing, and to be able to remove the manufactured bag before the complete opening of the welding jaws, which in this manner allows advancement of the amount of web required for the manufacture of another bag.

Known machines produce an advancement of the web, for each working cycle, which corresponds to a rotation through 360 degrees of the primary shaft or camshaft. In particular, current welding and cutting devices operate at speeds in the order of 150 cycles per minute. This entails the constructin of very sturdy and sophisticated machines, since at such speeds wear and the possibility of breakdowns are obviously increased, adjustment is more complicated and maintenance is more demanding. Furthermore, conventional machines usually operate along a horizontal line, which increases the difficulty of discharging the manufactured bags at high speed. On the other hand slowing down the welding and cutting time compulsorily entails a respective decrease in the productivity of the machine.

SUMMARY OF THE INVENTION

The aim of the present invention is to eliminate the above described problem by providing an apparatus for manufacturing bags made of plastic material which allows to perform the advancement, welding, cutting, accumulation and extraction steps at a reduced operating speed, while achieving a higher overall degree of productivity with respect to conventional machines.

Within this aim, a further object of the present invention is to provide an apparatus for manufacturing bags made of plastic material which is simple in concept, safe and reliable in operation and versatile in use.

Another object of the invention is to provide an apparatus for manufacturing bags made of plastic material which facilitates stacking of the bags.

This aim and these objects, as well as other objects which will become apparent hereinafter, are achieved, according to the invention, by an apparatus for manufacturing bags made of plastic material, which is characterized in that it comprises a welding device having at least one pair of fixed jaws and at least one jaw which is movable between said fixed jaws for clamping respective intermittently advancing tubular web of plastic material, at least one cutting element cooperating with said movable jaw and being adapted for cutting said web of plastic materials upon clamping said movable jaw on said fixed jaws, an assembly for extracting and accumulating completed bags, including a plurality of needles arranged at each fixed jaw and actuated with reciprocating motion in the direction of sliding of said movable jaw so as to penetrate a bag clamped between said jaws, means for placing said bag adjacent to previously produced bags supported on said needles, and means for unloading a stack of manufactured bags.

BRIEF DESCRIPTION OF THE DRAWINGS

Further characteristics and advantages of the invention will become apparent from the detailed description of a preferred but not exclusive embodiment of the apparatus for manufacturing bags made of plastic material, illustrated only by way of non-limitative example in the accompanying drawings, wherein:

FIG. 3 is a sectional view taken along the line III—III of FIG. 2;

FIGS. 4*a*, 4*b*, 4*c*, 4*d* and 4*e*, are schematic views of the successive operating steps of the apparatus.

DESCRIPTION OF THE PREFERRED EMBODIMENTS

Figure 1:
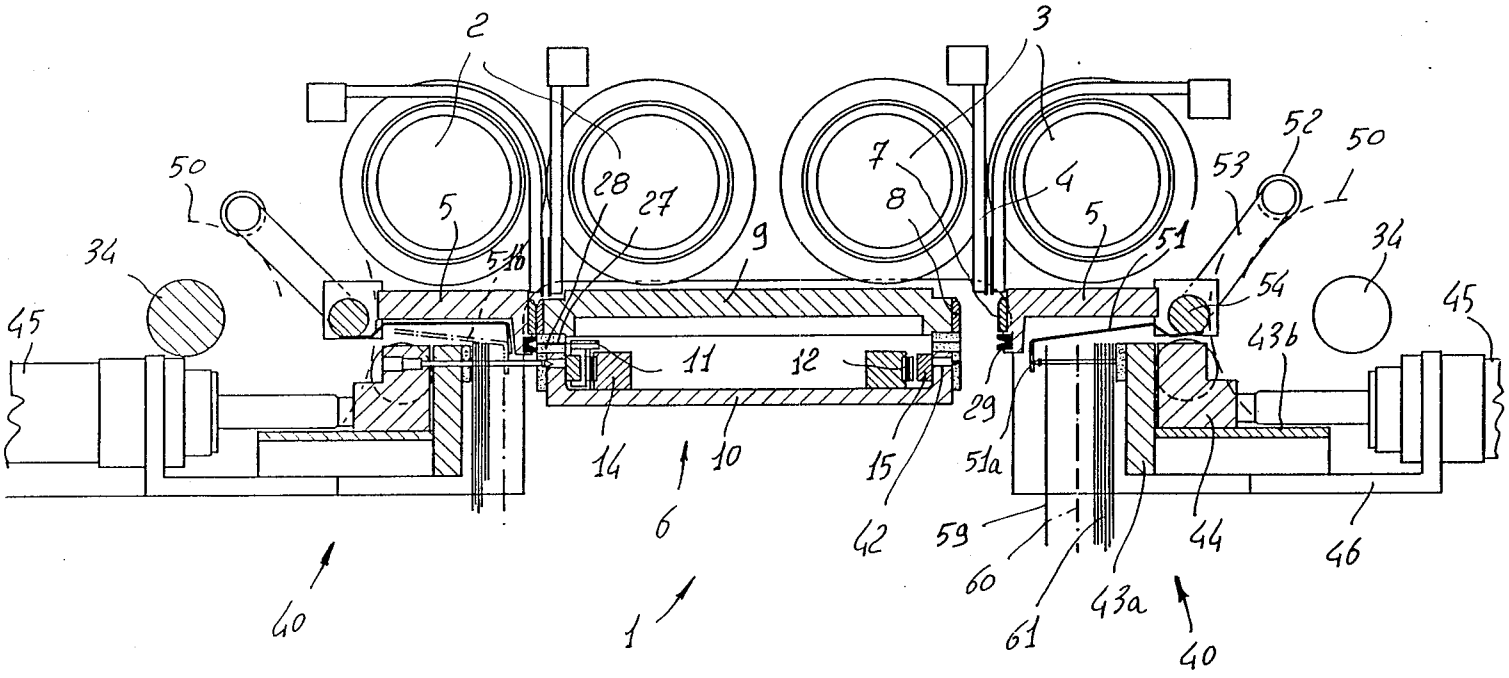
FIG. 1 is a vertical sectional view of the apparatus according to the invention.
Figure 2:
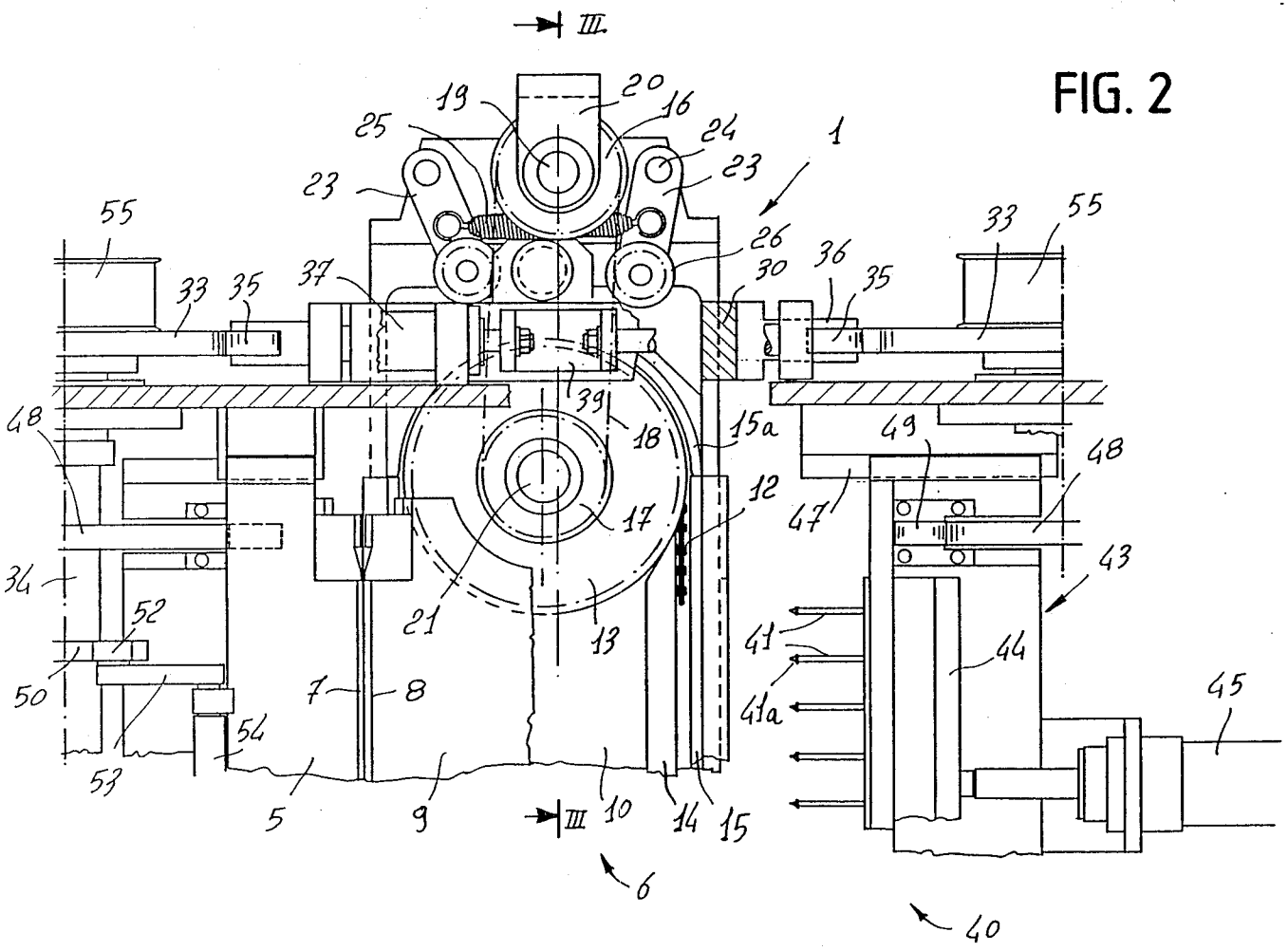
FIG. 2 is a fragmentary sectional plan view thereof.

With particular reference to the above described figures, the reference numeral 1 generally indicates the welding and cutting assembly of the apparatus for manufacturing bags made of thermoplastic material. The assembly 1 is arranged horizontally below a first and a second pair of rollers, respectively indicated by the reference numerals 2 and 3, having horizontal axes. The pairs of rollers 2 and 3 are adapted to symmetrically convey downwards, on the vertical plane defined by the related tangency plane, a respective web of thermoplastic material which forms, in a per se known manner, a flattened tubular sheath. The rollers 2 and 3 are actuated by appropriate drive elements so as to control the intermittent advancement of a preset portion of web, substantially corresponding to the length of the bag to be manufactured. Transport of the web is facilitated by respective guides or blower tubes 4.

The assembly 1 has a first and a second fixed welding jaw, indicated by the reference numeral 5, arranged facing each other at said first and second pair of rollers 2 and 3. A movable welding jaw 6 is arranged between the fixed jaws 5 and is actuated with reciprocating motion so as to alternately clamp onto one or the other of said fixed jaws. The fixed jaws 5 each bear a conventional heating element 7 which is adapted to cooperate with a respective opposite heating element 8 rigidly coupled with a respective opposite heating element 8 rigidly coupled to the movable jaw 6.

The movable jaw 6 is substantially constituted by a base 9 which is downwardly closed by a cover 10 defining an elongated box-like container inside which a band cutting element 11 is arranged. The cutting element 11 is movable along an annular path defined by a toothed belt 12 to which it is rigidly coupled. The belt 12 winds on a pair of toothed wheels 13, each expediently having a vertical axis and being arranged proximate to the opposite ends of said movable jaw, so that said annular path has rectilinear portions parallel to the sides of the jaws bearing the heating elements 8. The cutting element 11 is guided along said rectilinear portions between an inner guide 14 and an outer guide 15 having a portion 15*a* extending around the periphery of the toothed wheels 13.

The cutting element 11 is actuated by means of a pair of pulleys 16,17 around which a transmission belt 18 is wound. The pulley 16 is keyed to the lower end of a vertical shaft 19, rotatably supported by a bracket or support portion 20 of the fixed frame of the machine, while the pulley 17 is mounted on a pivot 21, constituting the axis of one of the toothed wheels 13, having a driving function and being rigidly associated therewith. The shaft 19 receives its motion through an angular transmission 22. A pair of tensioning elements 23, pivoted at 24 and actuated by a spring 25, ensure the tension of the transsmission belt 18 as the pulley 17 moves rigidly coupled to the movable jaw 6. The tensioning elements 23 act on opposite sides on the belt by means of related rollers 26.

The cutting element 11 has a blade 27 slideable in a slot defined on a horizontal plane between a pair of edges 28 rigidly associated, respectively, with the cover 9 and with the base 10 of the movable jaw 6. In front of said slot, a substantially U-shaped elastic gasket 29 is rigidly coupled to the fixed jaws 5 and, as will become apparent hereinafter, is intended to firmly adhere to the movable jaw 6 upon the clamping of the latter on said fixed jaw. It should be noted that said slot and said U-shaped gaskets 29 are arranged below the heating elements 7,8 of the welding jaws.

The movable jaw 6 is carried by a bracket 30 which is slideable on a horizontal stem 31, rigidly coupled to the fixed frame of the machine. Conveniently, the jaw 6 is linked to the bracket 30 by means of a pneumatic cylinder 32. It should be noted that the direction of sliding of the jaw 6, defined by the stem 31, is perpendicular to the rectilinear extension portions of the belt 12 bearing the cutting element 11.

The movable jaw 6 is actuated with reciprocating motion by means of a pair of opposite cams 33. The cams 33, hereinafter termed sliding cams, are respectively mounted on a shaft 34 and act on a roller 35 which is rotatably carried by a fork 36 defined at a respective end of the bracket 30. A pair of opposite pneumatic cylinders 37, supported by the fixed frame of the machine and having their stem 38 rigidly coupled to a fixed coupling 39 above the bracket 30, is adapted to cooperate with the cams 33. The cylinders 37 are intended to supply the clamping pressure of the movable jaw 6 on the fixed jaws 5.

Below each fixed jaw 5 there is an extraction assembly, generally indicated at 40, which is adapted to stack the manufactured bags. The extraction assembly 40 has a plurality of needles 41 arranged side by side on a horizontal plane in the direction of sliding of the jaw 6. At the needles 41, the movable jaw 6 has holes 42 which the points of said needles are adapted to penetrate.

The needles 41 are carried longitudinally slideable in respective seats provided on the vertical portion 43*a* of a slider having a square profile and extending horizontally parallel to the related fixed jaw 5; the needles are rearwardly rigidly coupled to a crosspiece 44 which is movable on the horizontal portion 43b of said slider 43 upon the actuation of a jack 45. The jack 45 is carried protrudingly, by means of a bracket 46, rearwardly of said slider 43.

The slider 43 is slideably guided at its ends on supports 47 and is actuated with reciprocating motion, in the horizontal direction of sliding of the movable jaw 6, by means of a second cam 48, hereinafter termed extraction cam, mounted on the shaft 34. The cam 48 engages a roller 49 which is rotatably carried on the slider 43.

A further cam 50, intended to actuate the oscillation of a fork 51 adapted to retain the extracted bag to place it adjacent to the previously manufactured ones, is furthermore mounted on the shaft 34. The cam 50 is engaged by a roller 52 which is rotatable at one end of a crank 53 pivoted on the axis 54 of the fork 51. The fork 51 is frontally provided with an edge 51*a* adapted to intercept, in the lowered position 51*b*, the upper flap of the extracted bag and having appropriate recesses for the free passage of the needles 41 in said lowered position.

The pair of shafts 34 bearing the cams 33, 48 and 50 is actuated in rotation, by means of a related end pulley 55, by motor means or a central drive element, not illustrated in the drawings, the shaft 56 whereof controls the driving pulley 57. The motor furthermore actuates, by means of the angular transmission 22, the cutting element 11 of the device.

The operation of the described device is as follows, with particular reference to FIGS. 4*a*–4*e* related only to the web conveyed by the rollers 2, which web is hereinafter indicated at 58. The movable jaw 6, actuated by the sliding cams 33 along the stem 31, has a reciprocating motion between the opposite fixed jaws 5, on which it alternately clamps so as to transversely weld the bands of thermoplastic material which vertically descend respectively from the pairs of rollers 2 and 3. The pneumatic cylinders 37 ensure the clamping pressure required for the welding, which is performed in a per se known manner by the heating elements 7,8. It should be noted that while the web conveyed by the rollers 2 is clamped between the jaws 5 and 6 and is being welded, the web conveyed by the rollers 3 is free and can thus advance by the preset distance.

Simultaneously with the welding, the cutting of the web is performed by the cutting element 11 rotatably carried by the belt 12 on the movable jaw 6. The cutting element 11 is actuated synchronously with the reciprocating motion of the jaw 6 so as to perform a cutting cycle at each complete stroke of said jaw.

The fact should be particularly stressed that, upon the clamping of the jaws, the U-shaped gasket 29 deforms so as to lock the web at the edges 28 between which the slot for the passage of the cutting blade 27 is defined. In particular, the gasket opens so as to tension the web and thus ensure optimum cutting conditions even at relatively high speeds. The gasket 29 furthermore locks the web before the jaws are fully closed and releases it after their reopening. This allows full exploitation of all the time required to effect welding to carry out the cutting operation, thus allowing a lower speed cutting operation to be effected without reducing the overall output of the apparatus.

At the web welding and cutting step, the extraction cam 48 actuates the advancement of the slider 43 (FIG. 4*a*). The needles 41 therefore penetrate the band 58 below the cutting line. Then the lifting of the fork 51, which was in lowered position (FIG. 4*b*) in the preceding step, is actuated by means of the cam 50. This allows the return stroke of the slider 43 (FIG. 4*c*). This stroke determines the extraction of the manufactured bag, indicated at 59 in the drawings, which is retained on the needles 41 provided, for this purpose, with an enlarged point 41*a*. In this step the movable jaw 6 separates from the fixed jaw 5 to move and perform the welding and cutting of the opposite web conveyed by the rollers 3; the web 58 is thus released, as mentioned, so as to be able to advance by the preset amount.

Upon actuation of the cam 50, the fork 51 is subsequently rotated in the lowered position, so as to intercept, with the edge 51*a*, the end of the needles 41 (FIG. 4*d*). In this manner, upon the subsequent advancement of the slider 43 for the manufacture of another bag (see FIG. 4*a* again), the bag 59 is retained so as to slide on the needles 41 to the position indicated at 60 in the drawings.

The manufactured bags are therefore placed vertically adjacent to one another, forming a pack 61 on the needles 41, as illustrated in FIG. 1. When this pack reaches the intended size, substantially delimited by the same line 60, the pack is unloaded. For this purpose the jack 45 actuates retraction of the crosspiece 44 to which the needles 41 are rigidly coupled (FIG. 4*e*). This causes the disengagement of said needles from the bags, which are then stacked by removal means, not illustrated in the drawings.

To summarize, the described apparatus performs the manufacture of two bags in each cycle, since it employs the phase of the manufacturing or production cycle in which the welding of the first web occurs for advancing the second web. This allows to decrease the operating speed with respect to conventional machines while nevertheless significantly increasing overall productivity of the apparatus. Furthermore, by simultaneously operating with two web in plastic material, it is possible to simultaneously manufacture two different types of bags, e.g. differing in their dimensions or bearing different inscriptions or the like.

The fact should be furthermore stressed that differently from conventional machines the needles 41 of the apparatus according to the invention perform not only the accumulation of the bags, but also the extraction thereof.

It is furthermore naturally possible to construct the apparatus according to the invention for the production of a single bag per cycle, by operating with a single web of plastic material.

In the practical embodiment of the invention, the materials employed, as well as the shape and dimensions, may be any according to the requirements.

I claim:

1. Apparatus for manufacturing bags made of plastic material comprising:

intermittent advancement means for intermittently advancing tubular webs of plastic material along two parallel vertical planes, at least one welding device having at least one pair of fixed jaws and at least one movable jaw, said fixed jaws being arranged facing each other on a horizontal plane, said movable jaw being movable between said pair of fixed jaws for clamping tubular webs on said fixed jaws, thereby welding said webs intermittently advancing along said parallel vertical planes, said movable jaw defining a direction of movement, at least one cutting element cooperating with said movable jaw for cutting said tubular webs of plastic material upon clamping said movable jaw on said fixed jaws, extraction means for extracting and accumulating completed bags, said extraction means including a plurality of needles arranged at each of said fixed jaws, and reciprocating means for reciprocating each said plurality of needles in said direction of movement defined by said movable jaw for penetrating a bag clamped between said movable jaw and one of said fixed jaws, means for placing said bag adjacent to previously produced bags supported on said needles, and means for unloading a stack of manufactured bags.

2. Apparatus according to claim 1, wherein said movable jaw comprises;

at least one base, at least one cover downwardly closing said base, said base and cover defining at least one elongated box-like container having arranged therein said cutting element, ends and sides defined by said movable jaw, at least one pair of toothed wheels arranged at said ends defined by said movable jaws, welding elements arranged at said sides of said movable jaw, at least one belt wound around said at least one pair of toothed wheels, at least one annular path defined by said belt and having rectilinear portions, said rectilinear portions extending parallel to said sides defined by said movable jaw.

3. Apparatus according to claim 2, wherein said apparatus has a fixed frame and wherein at least one toothed wheel of said pair of toothed wheels defines an axis, said apparatus further comprising;

at least one substantially vertical shaft rotatably supported by said fixed frame, at least one pair of pulleys, at least one pulley of said pair of pulleys being mounted on said substantially vertical shaft, at least one other pulley of said pair of pulleys being mounted on said axis defined by said at least one toothed wheel, driving means for driving said at least one other pulley, and at least one transmission belt connecting said at least one pulley to said at least one other pulley.

4. Apparatus for manufacturing bags made of plastic material comprising:

intermittent advancement means for intermittently advancing tubular webs of plastic material along substantially parallel advancement planes, at least one welding device having at least one pair of fixed jaws and at least one movable jaw, said fixed jaws being arranged facing each other on a clamping plane, said clamping plane lying substantially perpendicular to said advancement planes, said movable jaw being movable between said pair of fixed jaws for clamping tubular webs on said fixed jaws, thereby welding said webs intermittently advancing along said advancement planes, said movable jaw defining a direction of movement, at least one cutting element cooperating with said movable jaw for cutting said tubular webs of plastic material upon clamping said movable jaw on said fixed jaws, extraction means for extracting and accumulating completed bags, said extraction means including a plurality of needles arranged at each of said fixed jaws, and reciprocating means for reciprocating each said plurality of needles in said direction of movement defined by said movable jaw for penetrating a bag clamped between said movable jaw and one of said fixed jaws, means for placing said bag adjacent to previously produced bags supported on said needles, and means for unloading a stack of manufactured bags.

5. Apparatus according to claim 4, wherein said movable jaw comprises;

at least one base, at least one cover downwardly closing said base, said base and cover defining at least one elongated box-like container having arranged therein said cutting element, ends and sides defined by said movable jaw, at least one pair of toothed wheels arranged at said ends defined by said movable jaws, welding elements arranged at said sides of said movable jaw, at least one belt wound around said at least one pair of toothed wheels, at least one annular path defined by said belt and having rectilinear portions, said rectilinear portions extending parallel to said sides defined by said movable jaw.

6. Apparatus according to claim 5, wherein said apparatus has a fixed frame and wherein at least one toothed wheel of said pair of toothed wheels defines an axis, said apparatus further comprising;

at least one shaft rotatably supported by said fixed frame, at least one pair of pulleys, at least one pulley of said pair of pulleys being mounted on said shaft, at least one other pulley of said pair of pulleys being mounted on said axis defined by said at least one toothed wheel, driving means for driving said at least one other pulley, and at least one transmission belt connecting said at least one pulley to said at least one other pulley.

* * * * *